US009142204B2

(12) United States Patent
Menor

(10) Patent No.: US 9,142,204 B2
(45) Date of Patent: Sep. 22, 2015

(54) SIREN

(75) Inventor: Adam R. Menor, Stephenson, MI (US)

(73) Assignee: Tyco Fire Products LP, Lansdale, PA (US)

( * ) Notice: Subject to any disclaimer, the term of this patent is extended or adjusted under 35 U.S.C. 154(b) by 443 days.

(21) Appl. No.: 13/389,614

(22) PCT Filed: Aug. 3, 2010

(86) PCT No.: PCT/US2010/044221

§ 371 (c)(1), (2), (4) Date: Mar. 5, 2012

(87) PCT Pub. No.: WO2011/019543

PCT Pub. Date: Feb. 17, 2011

(65) Prior Publication Data

US 2012/0152164 A1 Jun. 21, 2012

Related U.S. Application Data

(60) Provisional application No. 61/232,731, filed on Aug. 10, 2009.

(51) Int. Cl.
*G10K 7/06* (2006.01)
*G10K 7/00* (2006.01)

(52) U.S. Cl.
CPC ..... *G10K 7/06* (2013.01)

(58) Field of Classification Search
CPC ..... G10K 7/00; G10K 7/02; G10K 7/04; G10K 7/06
USPC ..... 116/147, 138, 139; 340/404.1, 404.2, 340/404.3; 446/205
See application file for complete search history.

(56) References Cited

U.S. PATENT DOCUMENTS 1,116,174 A * 11/1914 Upton ..... 116/147
2,514,129 A 7/1950 Horsley et al.

(Continued)

FOREIGN PATENT DOCUMENTS

EP 411168 A1 * 2/1991 ..... G10K 7/06

OTHER PUBLICATIONS

International Searching Authority, Written Opinion issued in International Application No. PCT/US10/044221, Sep. 29, 2010, 3 pages.

(Continued)

*Primary Examiner* — R. A. Smith
(74) *Attorney, Agent, or Firm* — Perkins Coie LLP

(57) ABSTRACT

A preferred siren including a base having a central axis and a peripheral wall circumscribed about the central axis to define an internal chamber. The peripheral wall includes a plurality of apertures in communication with the internal chamber. A rotor is disposed within the chamber and centrally aligned with the axis. The rotor includes a plurality of spaced apart fins radially disposed about the axis, each of the plurality of fins having an outermost portion at a peripheral edge of the rotor and an innermost portion located between the axis and the peripheral edge. An external housing cooperates with the base to enclose the rotor within the internal chamber, the external housing including a first plurality of ports and a second plurality of ports, the first and second plurality of ports being in fluid communication with the internal chamber of the base. A driver is coupled to the rotor and is powered by a supply of carbon-dioxide gas to rotate the rotor about the axis at a rotational speed such that external air is drawn through the first plurality of ports, into the chamber and out the second plurality of ports so as to generate an alarm sound having an intensity greater than 100 decibels (100 dB).

19 Claims, 7 Drawing Sheets

(56) References Cited

U.S. PATENT DOCUMENTS

| | | | | |
|---|---|---|---|---|
| 2,528,515 | A | 11/1950 | Heigis | |
| 2,756,416 | A * | 7/1956 | Griparis | 340/404.2 |
| 4,138,673 | A * | 2/1979 | Faust | 340/404.2 |
| 4,847,590 | A * | 7/1989 | Gosswiller | 340/404.2 |
| 5,825,901 | A * | 10/1998 | Hisey | 381/165 |
| 7,066,106 | B2 * | 6/2006 | Giebeler | 116/147 |

OTHER PUBLICATIONS

International Searching Authority, International Search Report issued in International Application No. PCT/US10/044221, Sep. 29, 2010, 7 pages.

"Alarm Signals," 46 CFR Ch. 1, § 113.25-12, p. 266 (Oct. 1, 2008 edition).

"Alarms," 46 CFR Ch. 1, § 193.15-30, pp. 379-380 (Oct. 1, 2007 edition).

"Pressure-Operated Alarm Test," *UL* 2127, pp. 23-24 (Mar. 22, 2001).

"Approval Standard for Carbon Dioxide Extinguishing Systems (Class No. 5420)," FM Approvals LLC, pp. 12 and 24 (Apr. 2007).

"NFPA 12: Standard on Carbon Dioxide Extinguishing Systems," pp. 12-12 to 12-13 (2008 edition).

"Carbon Dioxide System Components—Pressure Operated Siren," (Part No. 43118), Datasheet, Ansul Incorporated, Marinette, Wisconsin (1 page) (1992).

"$CO_2$ Siren Type POS-2A," Technical Drawing (redacted) of the siren of reference C06, Ansul Fire Protection, Marinette, Wisconsin (1 page) (Feb. 7, 1975).

"Rotor, Machined," Technical Drawing (redacted) of the rotor of the siren of reference C06, Ansul Fire Protection, Marinette, Wisconsin (1 page) (Feb. 25, 1987).

"Impeller Machined," Technical Drawing (redacted) of the impeller of the siren of reference C06, Ansul Fire Protection, Marinette, Wisconsin (1 page) (Apr. 12, 1984).

"Pressure Operated Siren (Part No. 419700): Component Description," Ansul Incorporated, Marinette, Wisconsin, p. 2-131 (Apr. 15, 2000).

"Pressure Operated Siren Assembly," Assembly Drawing (redacted) of the siren of reference C10, Ansul Incorporated, Marinette, Wisconsin (1 page) (Jun. 7, 1996).

"Nozzle-Impeller," Technical Drawing (redacted) of the nozzle in each of the sirens of references C06 and C10, Ansul Incorporated, Marinette, Wisconsin (1 page) (Jul. 30, 1975).

"$CO_2$ Component Description—Pressure Operated Siren," (Part No. 981574), Datasheet, Kidde Fire Systems, Ashland, Massachusetts (1 page) (Apr. 2002).

"Pneumatic Siren," P/N. CO2-1230, Fike Corporation, Blue Mountain, Missouri (2 pages) (revised issue: Jul. 2002).

* cited by examiner

SIREN

PRIORITY DATA AND INCORPORATION BY REFERENCE

This application is a 35 U.S.C. §371 application of International Application No. PCT/US2010/044221, filed Aug. 3, 2010, which claims the benefit of priority to U.S. Provisional Patent Application Nos. 61/232,731, filed Aug. 10, 2009, each of which is incorporated by reference in its entirety.

TECHNICAL FIELD

The present invention relates generally to a pressure operated siren, and more specifically to a gas operated siren subject to extreme operating conditions, such as for example, supply pressure or temperature.

BACKGROUND ART

A known pressure operated siren has a structure that includes a base and an external housing that together forms a chamber to house an internal rotor. The rotor is driven by a driver that is disposed externally of the chamber and powered by compressed gas. Rotation of the rotor by the driver pulls external air into the chamber and expels it out of the housing. The manner in which the air flow is expelled from the housing generates a sound wave forming the alarm of the siren. For these known pressure operated sirens, their performance is limited in one or more of the following areas: intensity of alarm sound and duration of the alarm sound.

DISCLOSURE OF INVENTION

Applicant has developed a compressed gas operated siren with a rotor and driver configuration capable of generating an alarm sound with an intensity ranging between about ninety to one hundred and twenty decibels (90 dB and 120 dB) or greater, and preferably greater than 95 dB, preferably substantially greater than about 100 dB and more preferably about 106 dB. Moreover, the preferred siren generates the alarm sound at the desired intensity for a duration that is substantially equal to the supply duration of the compressed gas powering the driver. The preferred siren also generates the alarm sound at the desired intensity in an operating environment that ranges between minus twenty and one hundred fifty degrees Fahrenheit (−20° F.-150° F.), preferably between 0° F. and 130° F., and more preferably less than 30° F. over a duration that is preferably as long as the available gas supply powering the driver.

In one preferred embodiment, a siren includes a base having a central axis and a peripheral wall circumscribed about the central axis to define an internal chamber. The peripheral wall preferably includes a plurality of apertures in communication with the internal chamber, and the base further includes an inlet having an inlet end for receiving a compressed gas and a discharge end for discharging the gas. A rotor is disposed within the chamber and centrally aligned with the axis. The rotor preferably includes a plurality of fins radially spaced and disposed about the axis. Each of the plurality of fins extends radially inward along a fin axis that intersects the central axis, and each fin extends from a peripheral edge of the rotor to a tip portion. Each fin further includes a pair of lateral edges that extend symmetrically about the fin axis from the peripheral edge to the tip portion.

The preferred siren further includes an external housing that cooperates with the base to enclose the rotor within the internal chamber. The external housing preferably includes a first plurality of ports and a second plurality of ports, the first and second plurality of ports being in fluid communication with the internal chamber of the base. A driver is disposed externally of the internal chamber adjacent and coupled to the rotor to rotate the rotor about the central axis. The driver includes a surface preferably in line with the discharge end of the inlet to be impacted with the discharged gas. A nozzle insert is preferably disposed within the inlet between the inlet end and the discharge end. The nozzle insert defines a preferably converging-diverging internal passageway for the compressed gas in the direction from the inlet end to discharge end in order to condition the compressed gas before discharge from the discharge end of the inlet.

In one aspect, the lateral edges of each of the fins of the rotor include lateral surfaces that are symmetrically disposed about the fin axis. The lateral edges preferably include a first portion and a second portion defining an included angle therebetween ranging from about one hundred thirty to about one hundred forty degrees (130°-140°). In another aspect of the preferred fin, the second portion of each lateral edge converges toward the fin axis to define an included angle between the second portions of about twenty-five degrees to about thirty degrees (25°-30°). Preferably for each fin, the peripheral edge defines a fin base that is radially wider than the tip portion.

In another aspect of the preferred siren, the internal passageway of the nozzle insert defines a longitudinal axis and includes an initial portion, an intermediate portion and a terminal portion. The initial portion is preferably substantially frustroconical to define an included angle with the longitudinal axis of about sixty degrees (60°); the intermediate portion defines a substantially constant diameter, and the terminal portion is preferably of a variable diameter with a minimum diameter, a maximum diameter and a radiused transition between the minimum and the maximum diameter. In one preferred embodiment of the nozzle insert, the minimum diameter is about 0.125 inches, the maximum diameter is about 0.235 inches, and the radiused transition has a radius of curvature of about 0.64 inches.

In another preferred embodiment of the siren, the siren includes a base having a central axis and a peripheral wall circumscribed about the central axis to define an internal chamber. The peripheral wall includes a plurality of apertures in communication with the internal chamber, and the base includes an inlet having an inlet end for receiving a compressed gas and a discharge end for discharging the gas. A rotor is disposed within the chamber and centrally aligned with the axis, and an external housing cooperates with the base to enclose the rotor within the internal chamber. The external housing preferably include a first plurality of ports and a second plurality of ports, the first and second plurality of ports being in fluid communication with the internal chamber of the base. A driver is disposed externally of the internal chamber adjacent and coupled to the rotor to rotate the rotor about the central axis. The driver has a surface preferably in line with the discharge end of the inlet to be impacted with the discharged gas. A nozzle insert is preferably disposed within the inlet between the inlet end and the discharge end, the nozzle insert defining a converging-diverging internal passageway for the compressed gas in the direction from the inlet end to discharge end in order to condition the compressed gas before discharge from the discharge end of the inlet.

In another preferred embodiment, a siren includes a base having a central axis and a peripheral wall circumscribed about the central axis to define an internal chamber. The peripheral wall includes a plurality of apertures in communication with the internal chamber, and the base includes an inlet having an inlet end for receiving a compressed gas and a discharge end for discharging the gas. A rotor is disposed within the chamber and centrally aligned with the axis. The rotor preferably includes a plurality of fins radially spaced and disposed about the axis. Each of the plurality of fins extending radially inward along a fin axis to intersect the central axis, and each fin extends from a peripheral edge of the rotor to a tip portion. Each fin includes pair of lateral edges that preferably extend symmetrically about the fin axis from the peripheral edge to the tip portion. An external housing cooperates with the base to enclose the rotor within the internal chamber. The external housing preferably include a first plurality of ports and a second plurality of ports, the first and second plurality of ports being in fluid communication with the internal chamber of the base. A driver is disposed externally of the internal chamber adjacent and coupled to the rotor to rotate the rotor about the central axis. The driver has a surface in line with the discharge end of the inlet to be impacted with the discharged gas.

In yet another preferred embodiment, provided is a pressure operated siren to be powered by a compressed gas supply of a specific duration. The siren includes a base having a central axis and a peripheral wall circumscribed about the central axis to define an internal chamber. The peripheral wall includes a plurality of apertures in communication with the internal chamber. A rotor is disposed within the chamber and preferably centrally aligned with the axis. The rotor preferably includes a plurality of spaced apart fins radially disposed about the axis to define an interior space. Each of the plurality of fins has an outermost portion at a peripheral edge of the rotor and an innermost portion located between the axis and the peripheral edge. An external housing cooperates with the base to enclose the rotor within the internal chamber. The external housing preferably includes at least one port in fluid communication with the internal chamber of the base and the interior space of the rotor. A driver is coupled to the rotor to rotate the rotor about the axis at a rotational speed such that external air is drawn through the at least one port so as to generate a sound having an intensity greater than about 100 dB over a duration substantial equivalent to the specific duration of the compressed gas supply. Each of the plurality of fins includes a pair of lateral surfaces extending preferably symmetrically about a fin axis. The lateral surfaces further preferably converge toward the fin axis in the direction from the peripheral edge to the innermost portion. Each of the preferred lateral surfaces define a pair of lateral edges about the fin axis, each lateral edge having a first portion and a second portion. The first and second portions preferably define an included angle therebetween of about one hundred-thirty degrees (130°). Moreover, one of the first and second portions of the pair of lateral edges converge at the fin axis to define an included angle therebetween of about twenty-five degrees (25°). The preferred rotor further includes a plurality of openings between radially adjacent fins of the rotor. The openings are preferably in fluid communication with the apertures of the peripheral wall of the base. The driver rotates the rotor such that the openings move radially relative to the apertures to generate the sound at a preferred intensity of about 106 dB. When the preferred siren is exposed to an ambient environment of less than thirty degrees Celsius (30° C.), the sound generated is substantially greater than 100 dB.

In another preferred embodiment of the siren to be powered by a compressed gas supply of a specific duration, the siren includes a base, a housing in cooperation with the base defining an internal chamber having a central axis. A rotor is preferably disposed within the chamber. A first means is provided for driving the rotor in an ambient environment less than thirty degrees Fahrenheit, and a second means is provided for generating sound having an intensity greater than about 95 dB wherein when the siren is exposed to an ambient temperature ranging from about −20° F. to about 150° F. The intensity of the sound preferably lasts for a duration equivalent to the specific duration of the compressed gas supply. The first means preferably includes a compressed gas supply of a specific duration, and the sound intensity has a duration substantially equivalent to the specific duration of the gas supply. The first means preferably further includes a driver and a nozzle insert having a converging-diverging passageway to condition a compressed gas to impact the driver. In one preferred aspect, the second means includes a plurality of radially spaced fins disposed about the rotor defining a plurality of openings therebetween. Each of the fins define a fin axis intersecting the central axis, and the second means includes a plurality of apertures radially disposed about the base. The first means rotates the rotor such that the fins direct a flow of air toward the openings with the plurality of openings moving radially relative to the apertures to segment the flow of air and generate the sound.

Another preferred embodiment provides for a method of operating a siren having an external housing with a plurality of intake ports and output ports disposed about a base to define an internal chamber with a central axis, a rotor centrally disposed within the internal chamber, in which the base includes a peripheral wall having a plurality of apertures radially spaced about the central axis, and the rotor has a plurality of fins radially spaced about the central axis to define a plurality of openings of the rotor radially spaced between the fins, each of the fins defining a fin axis. The method preferably includes rotating the rotator about the central axis to generate a flow of air that moves over the plurality of fins symmetrically about the fin axis that radially intersects the central axis, moving the plurality of openings of the rotor radially past the apertures of the base to segment the flow of air so as to generate an alarm sound.

In yet another preferred method of operating a siren. The siren preferably including an external housing with a plurality of intake ports and output ports disposed about a base that defines an internal chamber with a central axis, a rotor centrally disposed within the internal chamber, and a driver external to the internal chamber that is coupled to the rotor. The preferred method includes conditioning a flow of compressed gas by flowing the gas through a converging-diverging nozzle, and discharging the gas to impact a portion of the driver so as to power the driver about the central axis and rotate the rotator about the central axis to generate an alarm sound.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1:
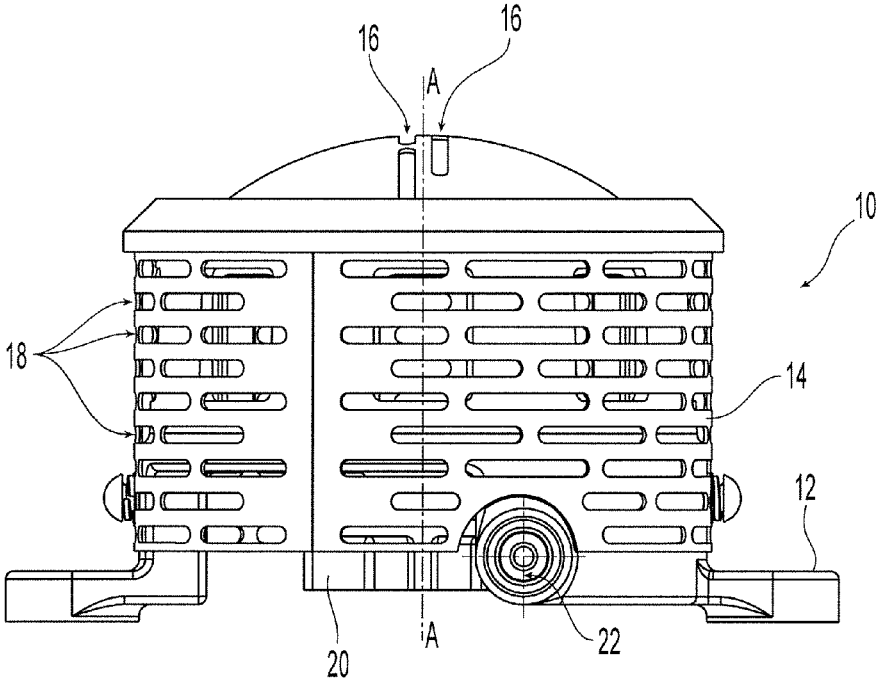
FIG. 1 is an elevation view of a first embodiment of a preferred siren.
Figure 1A:
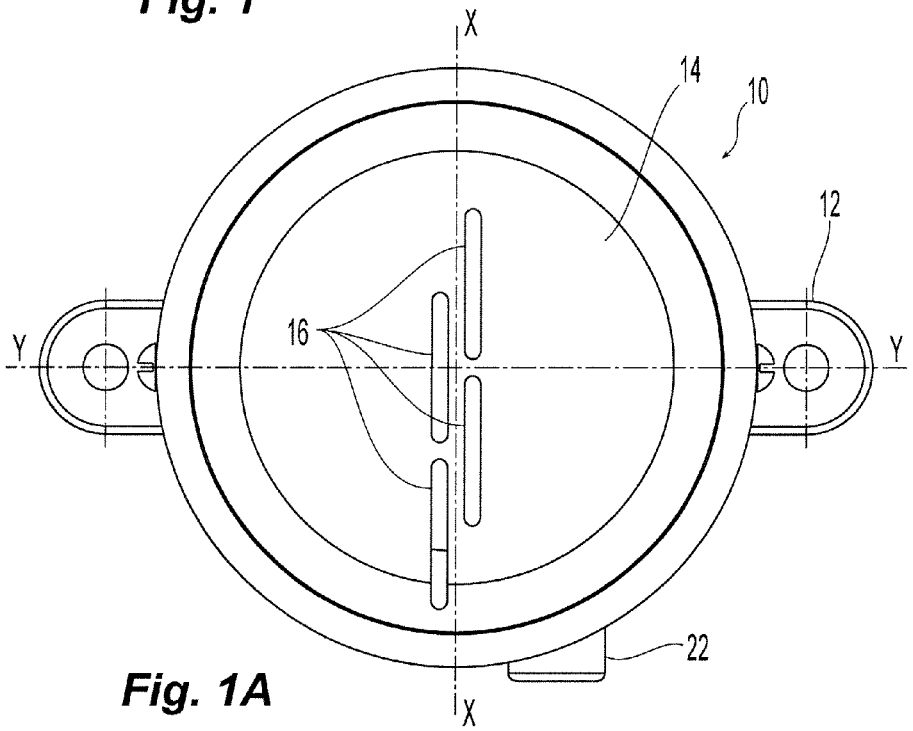
FIG. 1A is a plan view of the siren of FIG. 1 with a representative number of intake ports.

Shown in FIG. 1 and FIG. 1A is a first illustrative embodiment of a preferred siren 10. The siren 10 includes a base 12, and an external housing 14 having a plurality of intake ports 16 through which is drawn air into the siren housing and a plurality of exit ports 18 to expel the air from the housing and generate the alarm sound of the siren. Internal components of the siren, which draw in and expel the air through the siren housing 14 to generate the alarm sound, are housed within an interior chamber preferably formed on the base 12. The internal components preferably draw and expel the external air through centrifugal force. To generate the centrifugal force, the siren 14 includes a driver 20 preferably disposed externally of the interior chamber of the base 12. The driver 20 is preferably operated by pressure from a compressed gas, such as for example, carbon dioxide gas. The gas is delivered to power the driver 20 by way of an inlet 22 preferably formed on the base 12.

Figure 2:
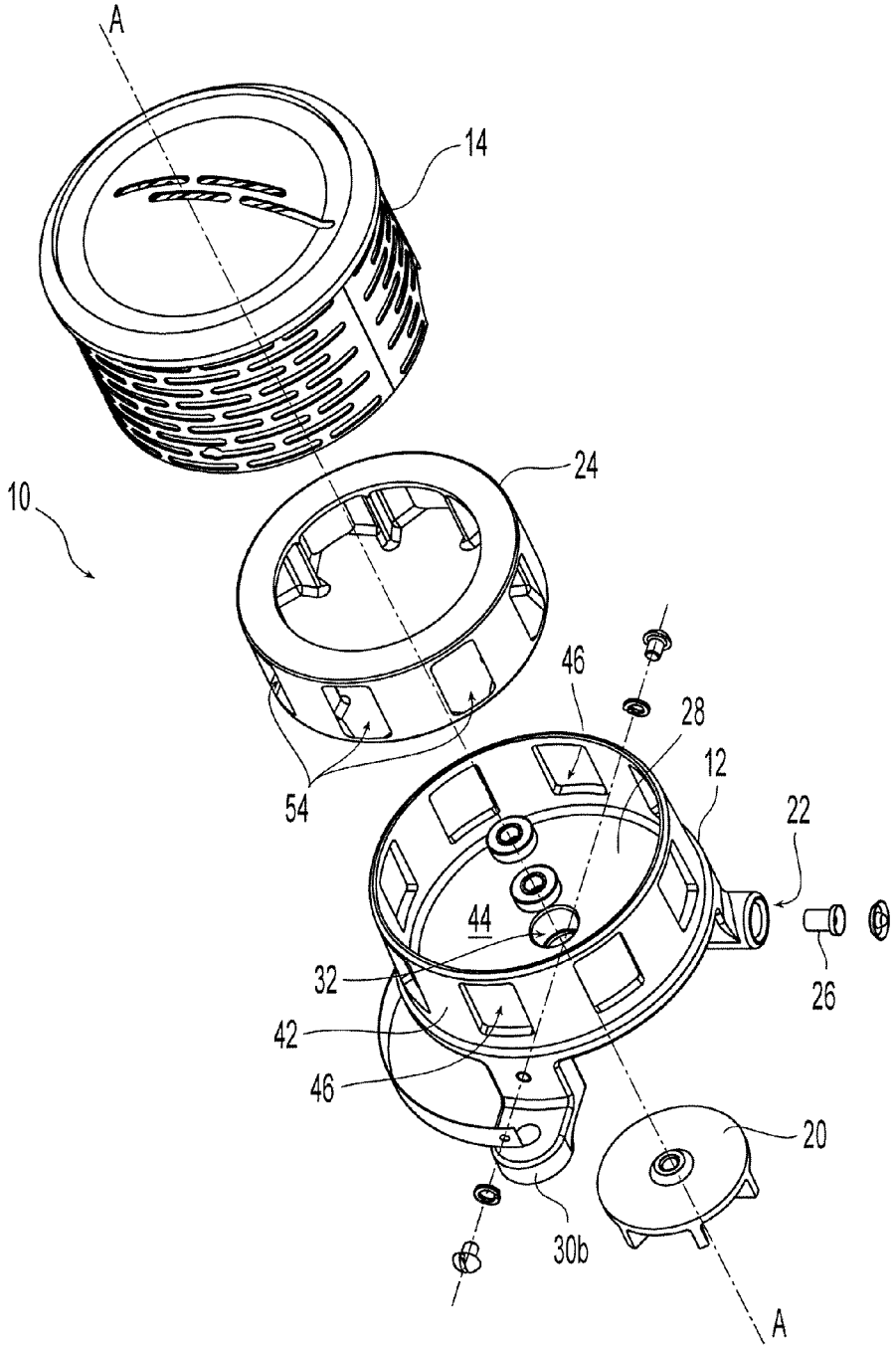
FIG. 2 is an exploded view of the siren of FIG. 1.

Shown in FIG. 2 is an exploded view of the preferred siren 10 and the preferred internal components of the siren. In particular, the internal components include a rotor 24 that is housed within an interior chamber of the base 12 and enclosed or surrounded by the external housing 14. The rotor 24 is preferably coupled to the external driver 20 by way of a central opening formed in the base 12. The internal components of the siren 10 further preferably include a nozzle insert 26 disposed within the inlet 22 of the base 12.

Figure 3:
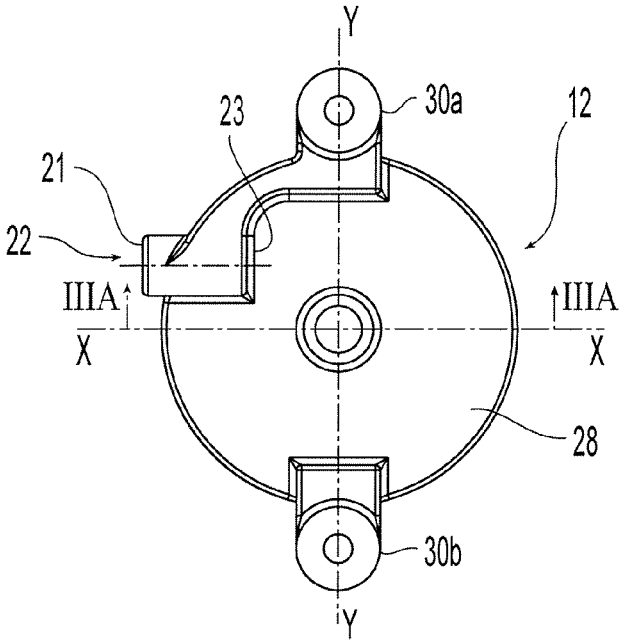
FIG. 3 is a plan view of the underside of a preferred base used in the siren of FIG. 1.
Figure 3A:
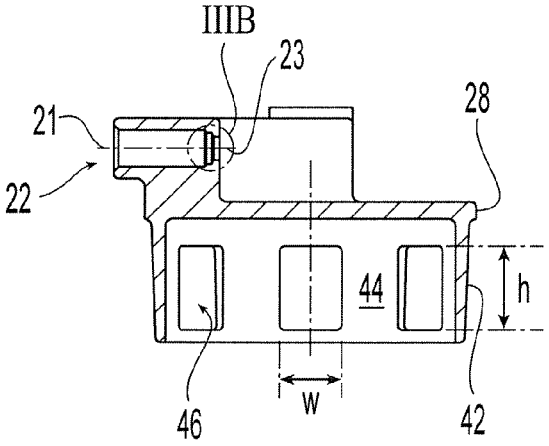
FIG. 3A is a cross-section view of the base of FIG. 3 along line IIIA-IIIA.
Figure 3B:
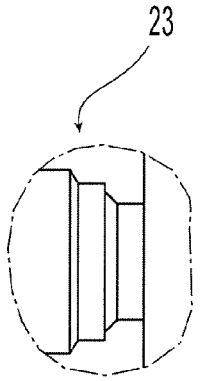
FIG. 3B is a detailed view of the inlet of the base in FIG. 3A.

The base 12 includes a preferably substantially circular platform 28 in which two or more diametrically opposed legs 30*a*, 30*b* are preferably formed about and extend below the base 28 to support the siren 10. Formed in the center of the platform 28 is a central hole 32 defining the central axis A-A of the siren 10 along which the siren components are preferably centered. Referring to FIGS. 3, 3A and 3B, shown is the inlet 22 formed in the base 12 preferably beneath the platform 28. The inlet 22 is a substantially cylindrical tube formed integrally with the base 12 having an intake end 21 for coupling to a gas source and discharge end 23 axially spaced from the intake end from which the gas is discharged to impact and rotate the driver 20. The preferred external driver 20 engages the bottom surface of the platform 28 and is located adjacent the inlet 22 preferably inline with the discharge end 23 so as to be rotated by the gas from the discharge end 23 of the inlet 22.

Figure 5:
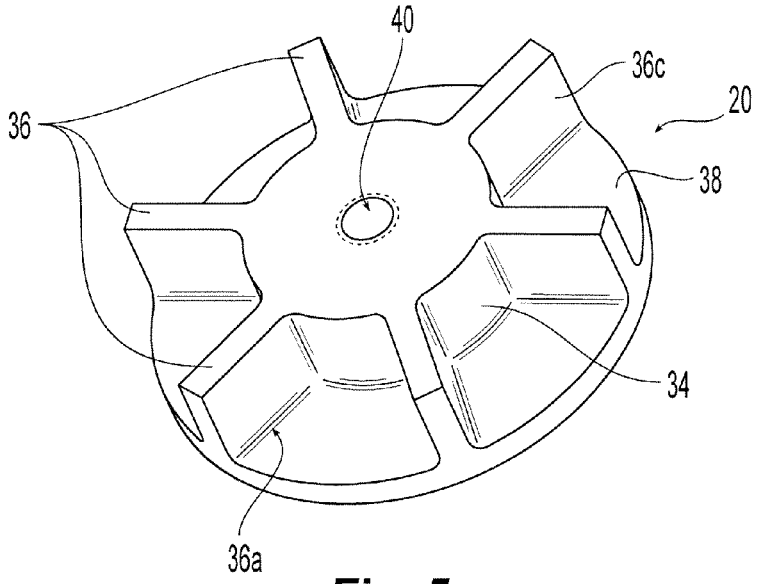
FIG. 5 is a perspective view of a preferred driver for use in the siren of FIG. 1.
Figure 5A:
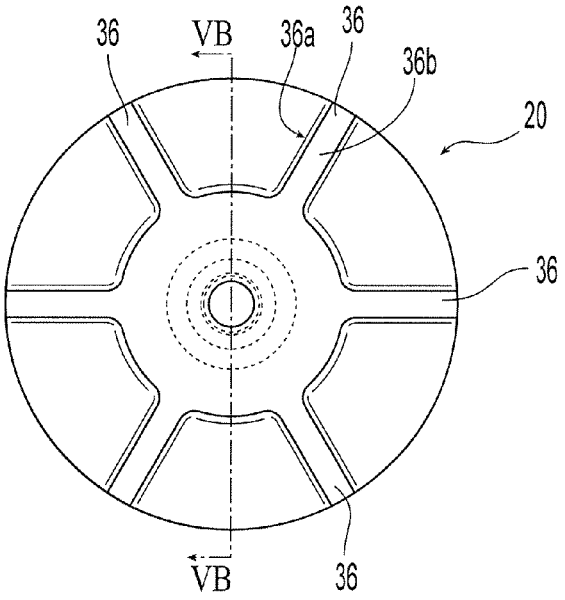
FIG. 5A is a plan view of the driver of FIG. 5.
Figure 5B:
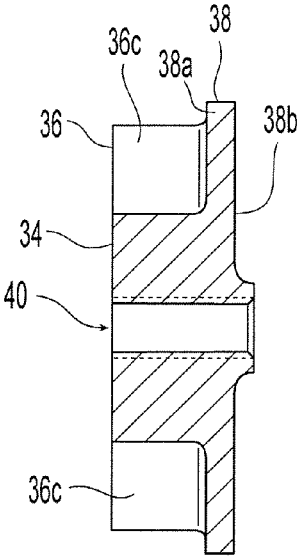
FIG. 5B is a cross-sectional view of the driver of FIG. 5A along line VB-VB.

Shown in FIGS. 5, 5A, and 5B is the preferred driver 20. The driver 20 is preferably of a unitary construction having a central core 34 about which are a plurality of radially spaced paddles 36. Preferably, the driver 20 includes six paddles 36 radially spaced every sixty degrees (60°). The preferred driver 20 further includes a base disc 38 having one side 38*a* from which the core 34 and plurality of paddles 36 extend. The opposite side 38*b* of the disc 38 is configured to face and engage the bottom surface of the platform 28. The driver 20 further includes a central bore 40 for engaging the rotor 24 and more preferably a shaft of the rotor 20 in order to rotate the rotor 24. Each of the paddles 36 have a wide base portion 36*a* and a narrower portion 36*b*. Referring to the FIG. 5B, the paddles 36 and more preferably the narrower portion 36*b* presents a deflecting face 36*c* against which the discharge gas can exert a driving force.

Referring again to FIG. 3, the driver 20 is centrally located against the base 12 with the disc surface 38*b* facing the bottom of the platform 28. The inlet 22 is preferably located to maximize the transfer of energy from the gas discharge to the paddle surface 36*c*. Accordingly, the inlet 22 is located so that the line of discharge from the discharge end 23 of the inlet 22 is substantially parallel and spaced from an axis X-X bisecting the platform 28. More specifically, the inlet 22 is located so as to generate a balanced relationship between the amount of torque generated and the rotational speed of the driver 20 so as to produce the desired intensity of the alarm sound ranging between about 90 dB and 120 dB.

Figure 4:
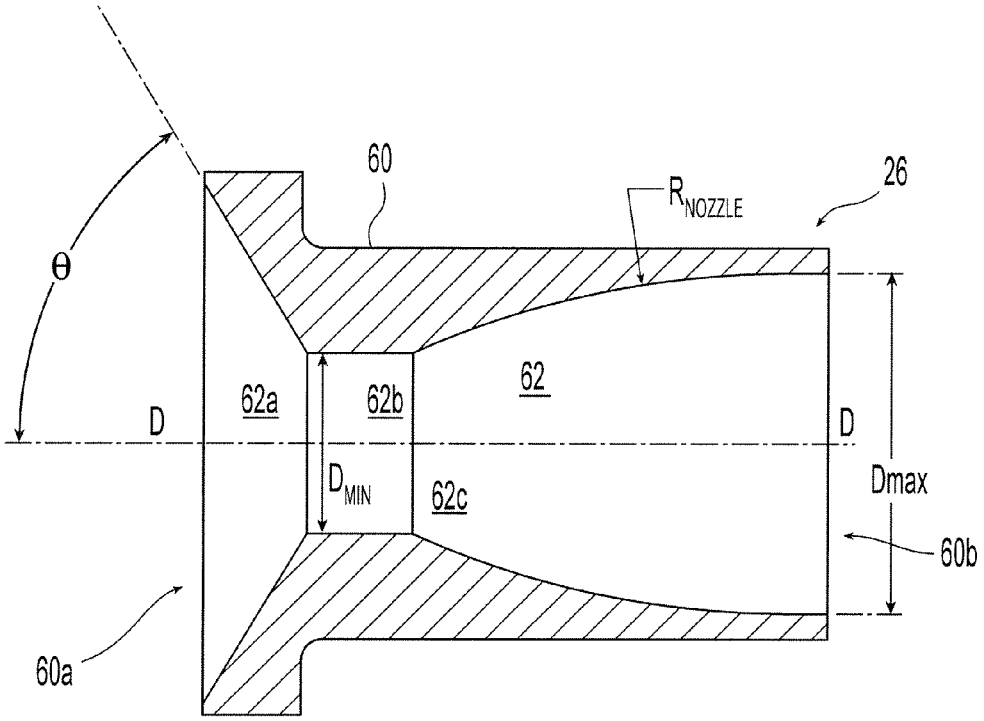
FIG. 4 is a cross-sectional view of a nozzle insert used in the siren of FIG. 1.

To further condition the discharge of compressed gas for powering the driver 20, disposed within the inlet 22 of the base 12 is a nozzle insert 26, as shown in FIG. 2. The nozzle insert 26 preferably funnels the compressed gas prior to exiting from the discharge end 23 of the insert 22. Shown in FIG. 4 is the preferred nozzle insert 26 which is a substantially cylindrical member 60 having an inlet orifice 60*a* and an outlet orifice 60*b* with an interior passageway 62 extending from the inlet 60*a* to the outlet 60*b*. The interior passageway preferably defines a converging-diverging nozzle passageway 62 to funnel the gas. Preferably, the passageway 62 includes an initial portion 62*a* at the inlet 60*a* having a substantially frustroconical configuration about the nozzle insert axis D-D. The interior walls of the member 60 forming the initial portion 62*a* preferably define an included angle θ with the axis D-D of about sixty degrees (60°) and more preferably about 59°. Accordingly, the initial portion 62*a* of the passageway converges to an intermediate portion of the passageway 62*b* having a preferably constant diameter along its axial length of about 0.125 inches to define the minimum diameter $D_{min}$ of the passageway 62. The intermediate portion 62*b* is continuous with and transitions to a preferred terminal portion of the passageway 62*c*, which has a variable diameter over its axial length. Preferably the terminal portion 62*c* expands from its smallest diameter, preferably 0.125 inches, and expands to a maximum diameter $D_{max}$ of about 0.235 inches. The interior surface of the member 60 defining the terminal portion 62*c* of the passageway is preferably defined by a radius of curvature $R_{nozzle}$ of 0.64 inches from its juncture with the intermediate portion 62*b* to the outlet orifice 60*b*.

Circumscribing the platform 28 and central axis of the base 12 is a peripheral preferably annular wall 42. The wall 42 in combination with the platform 28 defines a chamber 44 for housing the rotor 24. The internal chamber 44 preferably defines a diameter of about 3.8 inches with the preferred height of the wall 42 being about 1.5 inches and is more preferably about 1.48 inches. The peripheral wall 42 includes a plurality of apertures or openings 46 to provide fluid communication between the chamber 44, the external housing 14 and the outer environment. In the preferred embodiment of the base 12, the peripheral wall 42 has a total of eight substantially rectangular apertures 46 equiradially spaced about the wall 42. Each of the preferred base apertures 46 has a height h of about one inch and a width w of about 0.75 inches.

Disposed within the chamber 44 is the rotor 24, which is shown in greater detail in FIGS. 6, 6A, 6B and 6C. The rotor 24 is a cylindrical or disc-like assembly having an upper end 48*a*, a lower end 48*b*, with a preferably circular wall 49 formed between the upper and lower ends 48*a*, 48*b* to define an interior space 50 having a central axis B-B for coaxial alignment with the siren axis A-A. The rotor 24 is preferably open ended at the upper end 48*a* and the wall 49 preferably includes a plurality of openings or apertures 54 for communication with the interior space 50 of the rotor 24. In the preferred embodiment of the rotor 24, a total of eight preferably rectangular openings 54 are equiradially formed and spaced about the wall 49 of the rotor 24. Each of the rotor apertures has a height h1 of about one inch and more preferably about 1.06 inches and a width w1 of about two-thirds of an inch or 0.66 inches. The centers of the rotor apertures 54 are preferably radially spaced apart by an angle of about 45°. The preferred rotor 24 has an overall diameter $D_{rotor}$ of about 3.75 inches to form a close fit within the base chamber 44. The exterior surface of the wall 49 of the rotor 24 and the interior surface of the annular wall 42 of the base 12 define an annular gap therebetween of preferably ranging between 0.01 inch to about 0.1 inch. The preferred rotor 24 also has a preferred height $H_{rotor}$ of about 1.25 inches and more preferably about 1.26 inches.

The interior surface of the wall 49 of the rotor 24 preferably includes a plurality of fins 52 equiradially spaced about the rotor axis B-B. In the preferred embodiment of the rotor 24 shown in FIG. 6A, a total of eight fins are provided in which each fin is preferably formed between two radially adjacent rotor apertures 54. Each of the fins 52 extend from a peripheral edge 52*a* formed at the interior surface of the wall 49 to an innermost portion 52*b* located within the interior space 50 so as to define a fin axis C-C. The fin axis C-C preferably extends radially inward intersecting the central axis B-B of the rotor 24. The inner most portions 52*b* of the fins 52 preferably form fin tips which collectively define a tangential circle centered along axis B-B having a diameter $D_{int}$ of about 2.75 inches.

Figure 6:
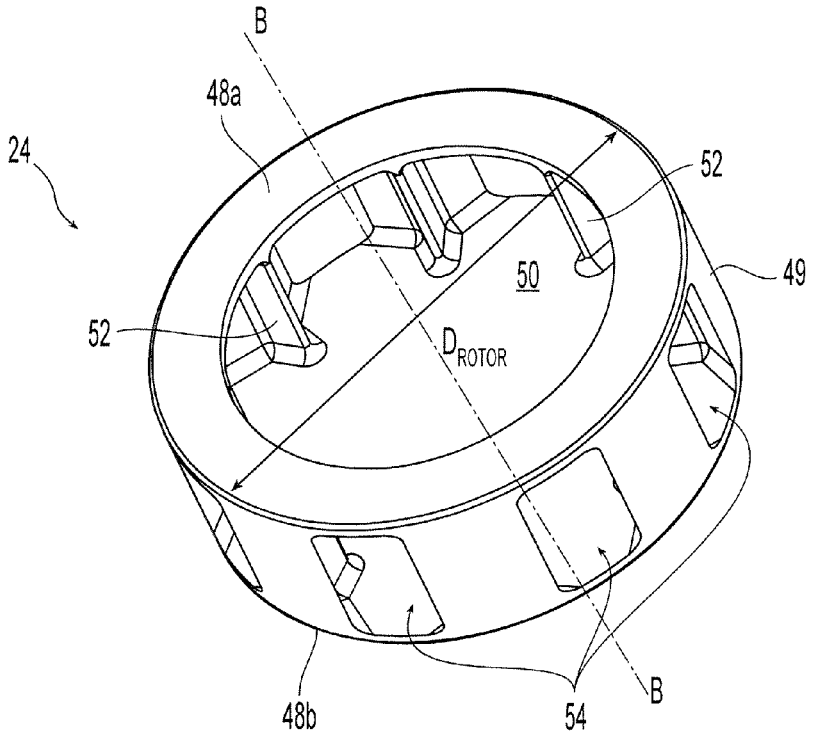
FIG. 6 is an isometric view of a preferred rotor for use in the siren of FIG. 1.
Figure 6A:
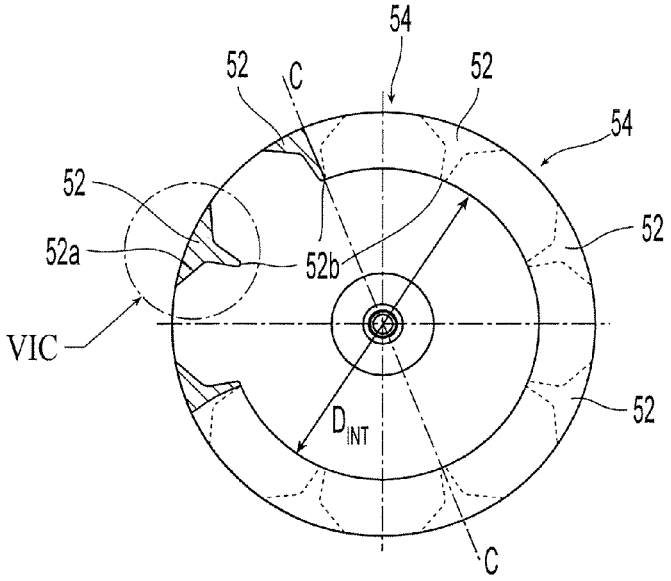
FIG. 6A is a plan view of the rotor of FIG. 6.

Shown in FIG. 6 is a detailed view of a preferred fin 52 formed in the rotor 24. The fin 24 preferably includes lateral surfaces that are formed or extend symmetrically about the axis C-C to define lateral edges 53 that preferably converge toward the fin axis C-C so as to define a wider base portion 52*c* and a narrower tip portion 52*d* of the fin 24. The edges 53 of the fin 52 preferably include a first edge portion 53*a* to define the base portion and a second edge portion 53*b* to define the tip portion. Preferably, the first and second edge portions 53*a*, 53*b* define an included angle therebetween a of about one hundred-thirty degrees (130°), and the tip portion 52*d* is preferably defined by second edge portions 53*b* defining an included angle β therebetween of about twenty-five degrees (25°).

The edges 53 of the fins 52 can be alternatively configured. For example, in one alternative embodiment not shown, the first and second portions 53*a*, 53*b* of the edges 53 can define an included angle α of about 140° and the second edge portions 53*b* of the edges 53 can define an included angle β therebetween of about thirty degrees. The alternate configuration can effectively extend the overall length of the fin 52 along the fin axis C-C such that the tangential circle defined by the innermost portions 52*b* of the fins collectively has a diameter $D_{int}$ of about 2.5 inches.

Figure 6B:
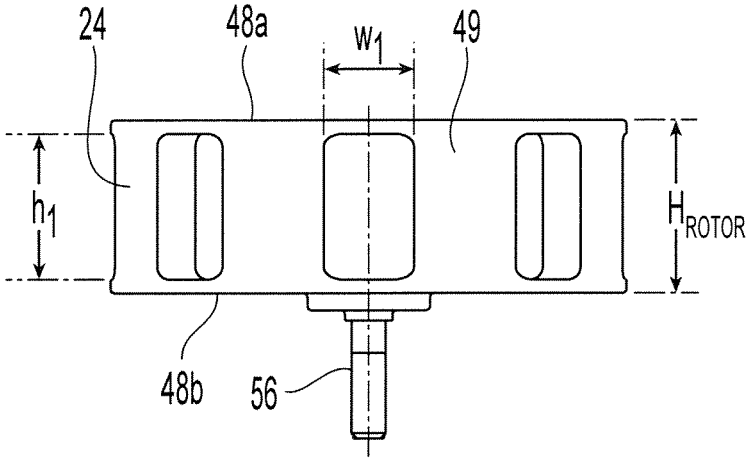
FIG. 6B is an elevation view of the rotor of FIG. 6.
Figure 6C:
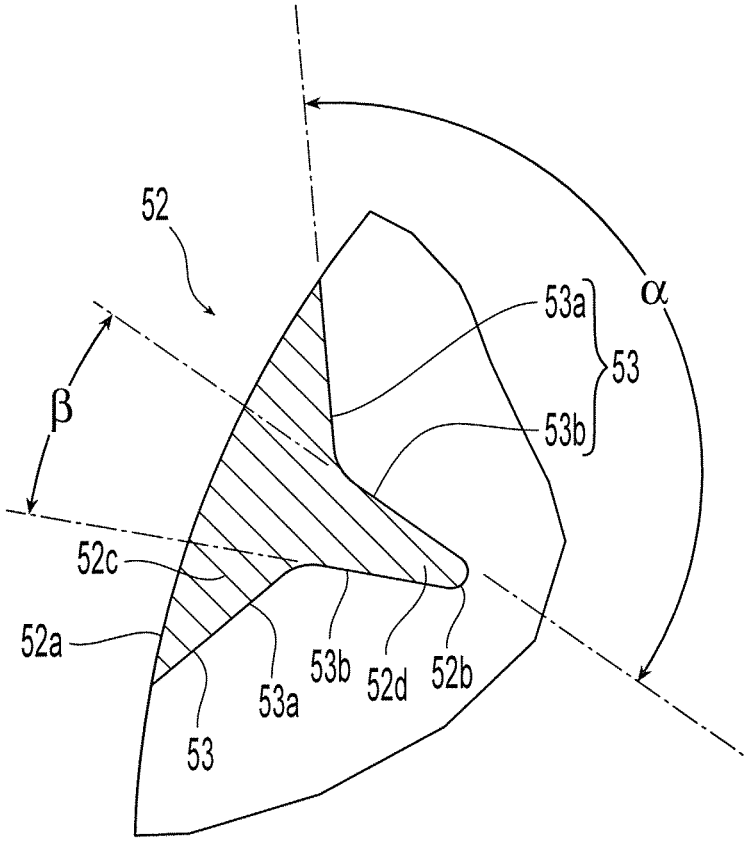
FIG. 6C is a detailed view of a fin for use in the rotor of FIG. 6.

Referring to FIG. 6B, the lower end 48*b* of the rotor 24 preferably includes a shaft 56 for coupling to the driver 20. Preferably, the shaft is threaded for a threaded engagement in the central bore 40 of the driver 20. The shaft 56 can be alternatively configured for other modes of coupling to the driver 20, for example, via a set screw, press fit, mechanical coupling.

Accordingly, with reference to FIG. 2, the siren 10 is preferably assembled by locating the rotor 24 within chamber 44 of the base 12 and with the shaft 56 inserted through the central opening 32 of the platform 32. The driver 20 is coupled to the shaft 56 of the rotor 24 and centrally installed underneath the platform 28 of the base 12. The external housing 14 is disposed over and secured about the rotor and base assembly 24, 12 by mechanical connection, i.e., threaded connection or snap-on. With the siren 10 fully assembled, the intake and exit ports 16, 18 are placed in fluid communication with the apertures 46 of the base 12, the apertures 54 of the rotor 24 and its interior space 50. Inserted within the inlet 22 of the base 12 is the nozzle insert 26, and preferably coupled to the inlet 22 is a supply of compressed gas, more specifically carbon dioxide gas ($CO_2$). The compressed gas has a supply duration that preferably ranges between about thirty seconds (30 sec.), as used in for example a high pressure $CO_2$ fire suppression system, to about one hour (1 hr.), as used in for example a low pressure $CO_2$ fire suppression system. In one preferred assembly, a pressure reducing orifice (not shown) is disposed inline between the gas supply and the inlet 22 using ¼ inch piping or tubing. A preferred pressure reducing orifice ranging in size from about 0.073 inch to 0.083 inch, and preferably 0.078 inch, provides for a reduction in inlet pressure ranging from about 35%-37%. Alternate pressure reducing orifices may be used provided the orifice reduces the inlet pressure while providing sufficient pressure for the desire sound intensity in decibels.

In operation of the siren 10, the carbon dioxide gas is released, automatically or manually, to the inlet 22. The gas is conditioned by the nozzle insert 26 and discharged from the discharge end 23 of the inlet 22. The discharged gas impacts the paddles 36 of the driver 20 and rotates the driver 20 about the siren axis A-A. The driver 20 being coupled to the rotor 24 rotates the rotor 24 within the interior chamber 44 of the base 12 which draws external air into the interior space 50 of the rotor 24 through the intake ports 16 of the external housing 14. The rotation of the rotor 24 and its fins 52 expel the air radially out of the apertures 54 which rotate about the axis A-A. More specifically, the volumetric flow rate in and out of the siren 10 is defined by configuration of the fins 52, including one or more of the angular spacing of the fins 52, the included angles of the fins 52, and/or the fin axial length.

The expelled air is sheared by the relative movement in the rotational direction between the rotating apertures 54 of the rotor 24 and the stationary apertures 46 of the base 12. The sheared air is further expelled out of the exit ports 18 of the external housing 14. The shearing of the expelled air stream produces a sound wave and the alarm sound of the siren 10. Accordingly, the sound level or intensity of the sound wave is directly related to the rotational speed of the rotor 24.

For the preferred siren 10, the preferred rotor 24 provides a means for drawing in a large volume of air, and the preferred driver 20 preferably in combination with the nozzle insert 26 provides a means for rotating the rotor 24 to generate an alarm sound of a desire intensity, greater than 90 decibels (dB), preferably greater than 95 dB, preferably greater than 100 dB and/or greater than 120 dB. More preferably, the preferred rotor 24 in combination with the preferred driver 20 and nozzle insert 26 provide a means for generating an alarm sound from the siren 10 substantially greater than 100 dB. The preferred configurations of the rotor 24, driver 20 and nozzle insert 26 provide means for generating an alarm sound at the desired intensity for a duration that is substantially equivalent to the duration of the compressed gas supply available to power the preferred driver 20. Moreover, the preferred means provides a siren configuration that can deliver the alarm sound at the desired intensity over a range of operating temperatures, such as for example, from about −20° F. to about 150° F., preferably from about 0° F. to about 130° F., and more preferably over a temperature range from about 0° F. to about of 30° F. In the case of where the siren 20 is operated by $CO_2$ gas, the operating temperature range of 0° F.-130° F. can provide for gas operating pressures ranging between about 300 psi. to about 2000 psi. (a high pressure system), and for operating temperatures of less than 0° F., the gas operating pressure is preferably about 100 psi. (low pressure system).

National Fire Protection Association ("NFPA"), Underwriter Laboratories, Inc. ("UL"), and Factory Mutual ("FM Global") provide standards regarding the testing, operation and/or installation of a gas or pressure operated valve. Additional regulations governing marine safety, and in particular alarm sound requirements, are provided in Title 46 of the Code of Federal Regulations—Shipping. ("46 CFR Ch. 1 et seq;" including §113.25-11 (Oct. 1, 2008 ed.) and §193.15-30 (Oct. 1, 2007 ed.)) Copies of the various sections of the standards and rules are attached to U.S. Provisional Patent Application No. 61/232,731, which is incorporated by reference in its entirety. In accordance with the standards, the preferred siren 10, when coupled to a supply of carbon dioxide gas sized in accordance with the standards, provides an alarm sound with an intensity ranging between 90 decibels (dB) and 120 dB over a duration equivalent to the duration of the available gas supply. Moreover, the preferred siren 10 provides an alarm sound with an intensity ranging between 90 decibels (dB) and 120 dB under one or more extreme conditions, such as for example, a minimum gas supply pressure and/or minimum temperature. For example, the preferred siren 10, over a duration equal to its gas supply, provides for an alarm sound having an intensity between 90 dB and 120 dB under a condition of less than thirty degrees Celsius (<30° C.). Other standardized tests satisfied by the preferred siren 20 include the fifty hour continuous operation test as provided in UL 2127, Section 31.1, and the five hour operation test as provided in FM 5420, Section 4.10.6.2, each of which is attached to U.S. Provisional Patent Application No. 61/232,731, which is incorporated by reference in its entirety.

In one particular sound level output test of the preferred siren 10, the gas supply of $CO_2$ was conditioned to zero degrees Fahrenheit (0° F.) (−17.8° C.) for sixteen hours. The sound level was then tested using a dosimeter positioned ten feet (10 ft.) from the siren 10. The siren 10 is mounted at a height of ten feet (10 ft.) in "free field" conditions as defined by the UL and FM standards attached to U.S. Provisional Patent Application No. 61/232,731, which is incorporated by reference in its entirety, i.e., outdoors on a clear day with a wind velocity of less than 5 mph at an ambient temperature of 15-25° C. Ten readings were collected for each of: i) the test run with a straight bore nozzle and ii) the test with the preferred converging-diverging nozzle insert 26. The results are shown below in Table 1.

TABLE 1

| | Test No. | | | | | | | | | |
|---|---|---|---|---|---|---|---|---|---|---|
| | 1 | 2 | 3 | 4 | 5 | 6 | 7 | 8 | 9 | 10 |
| Intensity (dB) (with straight bore nozzle insert) | 100 | 101 | 101 | 99 | 98 | 102 | 100 | 100 | 99 | 101 |
| Intensity (dB) (with converging-diverging nozzle insert) | 106 | 105 | 107 | 105 | 105 | 106 | 107 | 107 | 107 | 106 |

A separate test was conducted in which the alarm was operated in an ambient temperature of less than 30° F. In that test, the preferred siren 10 generated an alarm sound of greater than 100 dB for the duration of the available test gas supply which was about six minutes (6 min.).

The terms "about" or "approximately," as used throughout this application in the context of numerical values and ranges, refers to values or ranges that approximate or are close to the recited values or ranges such that the described embodiments can perform and/or function as intended or apparent to the skilled person from the teachings and descriptions contained herein. Thus, these teens, "about" or "approximately," encompass values beyond those resulting from systematic error. These terms make explicit what is implicit. It should be understood that all ranges set forth herein throughout the application include all numbers or values thereabout or therebetween of the numbers of the range. The ranges of values associated with the various preferred embodiments expressly denominate and set forth all integers, decimals and fractional values in the range. Therefore, any parameter such as for example, a length, area, volume, rate or pressure that is described as being "about" some value, includes the express value described, and could further includes the integer, decimal or fractional value thereabout or therebetween. Moreover, for any numerical values provided herein, it should be understood that the stated value further includes the value itself and an integer, decimal or fractional value thereabout.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A siren comprising:

a base having a central axis and a peripheral wall circumscribed about the central axis to define an internal chamber, the peripheral wall including a plurality of apertures in communication with the internal chamber, the base further including an inlet having an inlet end for receiving a compressed gas and a discharge end for discharging the gas, the discharge end being axially spaced from the inlet end;

a rotor disposed within the chamber and centrally aligned with the axis, the rotor having a plurality of fins radially spaced and disposed about the axis, each of the plurality of fins extending radially inward along a fin axis that intersects the central axis, each fin extending from a peripheral edge of the rotor to a tip portion, each fin having a pair of lateral edges that extend symmetrically about the fin axis from the peripheral edge to the tip portion;

an external housing that cooperates with the base to enclose the rotor within the internal chamber, the external housing including a first plurality of ports and a second plurality of ports, the first and second plurality of ports being in fluid communication with the internal chamber of the base;

a driver disposed externally of the internal chamber adjacent and coupled to the rotor to rotate the rotor about the central axis at a rotational speed such that external air is drawn through at least one of the first and second plurality of ports for generation of a sound; the driver having a surface in line with the discharge end of the inlet to be impacted with the discharged gas; and a nozzle insert disposed within the inlet between the inlet end and the discharge end, the nozzle insert defining a converging-diverging internal passageway for the compressed gas in the direction from the inlet end to discharge end in order to condition the compressed gas before discharge from the discharge end of the inlet.

2. The siren of claim 1, wherein the lateral edges of each of the fins includes lateral surfaces being disposed and symmetric about the fin axis.

3. The siren of claim 1, wherein each of the lateral edges includes a first portion and a second portion defining an included angle therebetween ranging from about one hundred thirty to about one hundred forty degrees (130°-140°).

4. The siren of claim 3, wherein each fin, the second portion of each lateral edge converges toward the fin axis to define an included angle between the second portions of about twenty-five degrees to about thirty degrees (25°-30°).

5. The siren of claim 1, wherein each fin, the peripheral edge defines a fin base that is radially wider than the tip portion.

6. The siren of claim 1, wherein the internal passageway of the nozzle insert defines a longitudinal axis and includes an initial portion, an intermediate portion and a terminal portion, the initial portion being substantially frustoconical to define an included angle with the longitudinal axis of about sixty degrees (60°), the intermediate portion being of a substantially constant diameter, and the terminal portion being of a variable diameter with a minimum diameter, a maximum diameter and a radiused transition between the minimum and the maximum diameter.

7. The siren of claim 6, wherein the minimum diameter is about 0.125 inches, the maximum diameter is about 0.235 inches, and the radiused transition has a radius of curvature of about 0.64 inches.

8. A siren comprising:

a base having a central axis and a peripheral wall circumscribed about the central axis to define an internal chamber, the peripheral wall including a plurality of apertures in communication with the internal chamber, the base further including an inlet having an inlet end for receiving a compressed gas and a discharge end for discharging the gas, the discharge end being axially spaced from the inlet end;

a rotor disposed within the chamber and centrally aligned with the axis, the rotor having a plurality of fins radially spaced and disposed about the axis, each of the plurality of fins extending radially inward along a fin axis that intersects the central axis, each fin extending from a peripheral edge of the rotor to a tip portion, each fin having a pair of lateral edges that extend symmetrically about the fin axis from the peripheral edge to the tip portion;

an external housing that cooperates with the base to enclose the rotor within the internal chamber, the external housing including a first plurality of ports and a second plurality of ports, the first and second plurality of ports being in fluid communication with the internal chamber of the base; and a driver disposed externally of the internal chamber adjacent and coupled to the rotor to rotate the rotor about the central axis at a rotational speed such that external air is drawn through at least one of the first and second plurality of ports for generation of a sound; the driver having a surface in line with the discharge end of the inlet to be impacted with the discharged gas.

9. The siren of claim 8, wherein the lateral edges of each of the fins includes lateral surfaces being disposed and symmetric about the fin axis.

10. The siren of claim 8, wherein each of the lateral edges includes a first portion and a second portion defining an included angle therebetween ranging from about one hundred thirty to about one hundred forty degrees (130°-140°).

11. The siren of claim 10, wherein each fin, the second portion of each lateral edge converges toward the fin axis to define an included angle between the second portions of about twenty-five degrees to about thirty degrees (25°-30°).

12. The siren of claim 8, wherein each fin, the peripheral edge defines a fin base that is radially wider than the tip portion.

13. A pressure operated siren to be powered by a compressed gas supply of a specific duration, the siren comprising:

a base having a central axis and a peripheral wall circumscribed about the central axis to define an internal chamber, the peripheral wall including a plurality of apertures in communication with the internal chamber;

a rotor disposed within the chamber and centrally aligned with the axis, the rotor having a plurality of spaced apart fins radially disposed about the axis to define an interior space, each of the plurality of fins having an outermost portion at a peripheral edge of the rotor and an innermost portion located between the axis and the peripheral edge, and each of the plurality of fins include a pair of lateral surfaces extending symmetrically about a fin axis, the lateral surfaces converging toward the fin axis in the direction from the peripheral edge to the innermost portion;

an external housing that cooperates with the base to enclose the rotor within the internal chamber, the external housing including at least one port in fluid communication with the internal chamber of the base and the interior space of the rotor; and a driver coupled to the rotor, the driver being powered by the compressed gas to rotate the rotor about the axis at a rotational speed such that external air is drawn through the at least one port so as to generate a sound having an intensity greater than about 100 dB over a duration substantial equivalent to the specific duration of the compressed gas supply.

14. The siren of claim 13, wherein each fin the lateral surfaces define a pair of lateral edges about the fin axis, each lateral edge having a first portion and a second portion, the first and second portions defining an included angle therebetween of about one hundred-thirty degrees (130°), one of the first and second portions of the pair of lateral edges converging at the fin axis and defining an included angle therebetween of about twenty-five degrees (25°).

15. The siren of claim 13, wherein the rotor further includes a plurality of openings between radially adjacent fins of the rotor, the openings being in fluid communication with the apertures of the peripheral wall of the base.

16. The siren of claim 15, wherein the driver rotates the rotor such that the openings move radially relative to the apertures to generate the sound at an intensity of about 106 dB.

17. The siren of any one of claims 13 or 15, wherein when the siren is exposed to an ambient environment of less than thirty degrees Celsius (30° C.), the sound generated is substantially greater than 100 dB.

18. The siren of claim 17, wherein the base includes an inlet in fluid communication with the driver for receiving the compressed gas to power the driver, the siren further including a nozzle insert disposed within the inlet to condition the gas, the nozzle having an interior surface defining a converging diverging passageway through which the gas flows.

19. The siren of any one of claims 13 or 15, wherein the base includes an inlet in fluid communication with the driver for receiving the compressed gas to power the driver, the siren further including a nozzle insert disposed within the inlet to condition the gas, the nozzle having an interior surface defining a converging diverging passageway through which the gas flows.

* * * * *